US007210587B1

(12) United States Patent
Singer et al.

(10) Patent No.: US 7,210,587 B1
(45) Date of Patent: May 1, 2007

(54) METHOD AND DISPLAY FOR SELLING WINDOW COVERINGS

(75) Inventors: James Singer, Sarasota, FL (US); Michael Kollman, Madison, WI (US)

(73) Assignees: Vista Products, Inc., Sarasota, FL (US); Lumino, Inc., Madison, WI (US)

( * ) Notice: Subject to any disclaimer, the term of this patent is extended or adjusted under 35 U.S.C. 154(b) by 382 days.

(21) Appl. No.: 10/849,968

(22) Filed: May 20, 2004

(51) Int. Cl.
*B42F 7/14* (2006.01)

(52) U.S. Cl. ..... 211/55

(58) Field of Classification Search ..... 211/55, 211/71.01, 85.26, 94.01; 434/72, 74, 75; 705/1, 22, 28, 400
See application file for complete search history.

(56) References Cited

U.S. PATENT DOCUMENTS

| | | | | |
|---|---|---|---|---|
| 886,057 | A | 4/1908 | Hockaday | |
| 1,045,372 | A | 11/1912 | Cohen | |
| 2,795,059 | A | 6/1957 | Mendelsohn | |
| 2,876,907 | A * | 3/1959 | Amberg | 211/11 |
| 3,430,364 | A | 3/1969 | Kirschbaum et al. | |
| 4,253,259 | A | 3/1981 | Schaffer et al. | |
| D278,954 | S | 5/1985 | Bolyn | |
| D303,460 | S | 9/1989 | Schouten | |
| 4,964,656 | A * | 10/1990 | Prentice | 281/44 |
| 5,505,747 | A | 9/1991 | Krautsack | |
| D334,587 | S | 4/1993 | Steinert | |
| D335,781 | S | 5/1993 | Moncrief et al. | |
| 5,228,857 | A | 7/1993 | Roland | |
| 5,370,024 | A | 12/1994 | Lerner et al. | |
| 5,720,396 | A | 2/1998 | Wegscheid et al. | |
| 5,758,781 | A * | 6/1998 | Lord et al. | 211/55 |
| 5,807,110 | A | 9/1998 | Hytry et al. | |
| 5,855,480 | A | 1/1999 | Housman | |
| 6,039,576 | A * | 3/2000 | Gabig et al. | 434/367 |
| 6,068,139 | A | 5/2000 | Brozak, Jr. | |
| 6,527,128 | B1 | 3/2003 | Samaria | |

OTHER PUBLICATIONS

"Comfortex Retail Merchandising Displays," *Window Fashions*, Apr. 2004, p. 27.

* cited by examiner

*Primary Examiner*—Sarah Purol
(74) *Attorney, Agent, or Firm*—Buchanan Ingersoll & Rooney PC

(57) ABSTRACT

In a method for selling window coverings a set of swatch cards and sample blinds are provided in a display unit. The swatch cards contain a piece of window covering material and a pricing table for a product being offered for sale. The card may contain other information about the product such as options and options. Each set of swatch cards will contain samples of all window covering materials available for the type of product with which the cards are associated. A photograph or other reproduction of each window covering material and a photograph of a window covering product could be used in place of actual samples.

24 Claims, 9 Drawing Sheets

| | 18 | 24 | 30 | 36 | 42 | 48 | 54 | 60 | 66 | 72 |
|---|---|---|---|---|---|---|---|---|---|---|
| 30 | 36 | 45 | 53 | 60 | 70 | 78 | 87 | 95 | 103 | 111 |
| 36 | 40 | 50 | 59 | 68 | 78 | 87 | 97 | 106 | 116 | 125 |
| 42 | 43 | 54 | 63 | 73 | 85 | 95 | 106 | 116 | 127 | 137 |
| 48 | 46 | 59 | 70 | 80 | 93 | 105 | 117 | 128 | 140 | 151 |
| 54 | 49 | 63 | 74 | 88 | 100 | 113 | 126 | 138 | 151 | 163 |
| 60 | 53 | 67 | 80 | 93 | 109 | 122 | 136 | 150 | 164 | 177 |
| 66 | 56 | 71 | 85 | 99 | 116 | 130 | 145 | 159 | 174 | 189 |
| 72 | 59 | 76 | 91 | 106 | 124 | 139 | 156 | 171 | 188 | 203 |
| 78 | 62 | 80 | 96 | 112 | 131 | 147 | 165 | 181 | 198 | 215 |
| Crown | 5 | 5 | 8 | 8 | 10 | 10 | 13 | 13 | 15 | 15 |

METHOD AND DISPLAY FOR SELLING WINDOW COVERINGS

FIELD OF THE INVENTION

The invention relates to the sale of window coverings of the type in which a window covering material extends from a headrail.

BACKGROUND OF THE INVENTION

There are a variety of window coverings in which a window covering material extends from a headrail and is raised and lowered by lift cords or drawn along a track by pull cords. One type of window covering is the venetian blind in which a series of horizontal slats are hung on two or more ladders that hang from a headrail. A similar product is the vertical blind in which a set of vertical slats are suspended from a track in the headrail. Most manufacturers offer slats for venetian blinds and vertical blinds in a variety of colors and materials including wood, vinyl, aluminum and composite materials. Another class of window covering contains a panel of fabric, woven woods or woven grasses hung on a headrail. Among these window coverings are pleated shades, cellular shades, roman shades and roll-up shades. In most of these shades the fabric panel is available in a number of colors and patterns, can be woven or non-woven and the weave can vary from sheer to tightly woven.

Traditionally, window coverings have been sold in standard sizes by department stores, discount stores and home centers. They have also been sold by custom fabricators who come to the home or office, measure the windows and make blinds to fit. Some retailers have offered both standard products and custom blinds. In recent years some retailers have sold blinds based upon measurements provided by the customer. These retailers keep a limited inventory of blinds in standard sizes and popular colors. If the customer does not want a blind from the retailer's current inventory, the retailer may custom order the blind from the manufacturer using the customer's measurements. Several retailers now offer blinds through a cut down program. Under this program the store stocks a set of blinds in standard sizes and has a machine that will trim the width of the shade to fit the customer's measurements. The length is adjusted by cutting excess material from the bottom of the shade.

Most retailers have a limited display of sample blinds and have sample books containing swatches of all the colors and kinds of window covering material that are available for a particular family of blinds. Sample books tend to be bulky and are cumbersome to transport. Nevertheless, many customers want to see the sample in the room where the window covering product will be installed before they will make a purchase decision. These customers must then borrow the sample book from the retailer. If the customer fails to return the book, the retailer must buy a new sample book. Many retailers buy several sample books to assure that one is always available for a customer. Pricing of window coverings is usually based upon the size of the blind. Size is determined by the width and length of the blind when the blind is in a closed position which corresponds to covering the entire window over which the blind is to be mounted. The retailer has a price book or set of price sheets for each type of window covering that is being offered for sale. The price books and price sheets are usually kept separate from the sample books.

Those customers who wish to buy window coverings form a home center, department store or large discount store usually will first look at the window covering products on display. Upon finding a product in the display that is of interest, the customer must then look at a sample book to determine if the product is available in a color and style that pleases the customer. After selecting one or more styles, the customer usually will then want to know what the product costs. To obtain pricing information the customer must find a sales person who must then retrieve the applicable price sheet and determine the cost of each item of interest in the size specified by the customer and with all the options selected by the customer. Many times the customer will immediately decide that the price is too high and go elsewhere. The result is that both the customer and the salesperson have spent much time on a transaction that has not resulted in a purchase and sale. Consequently, there is a need for a display of window covering products and method of selling window coverings in which the customer can, without help from a sales person, determine the price and available options of a window covering product which will fit the potential buyer's window.

There is also a need for a display of window covering products and method of selling window coverings in which product samples are available for the customer to easily select and take home with him or her. The samples should be easy to carry and inexpensive.

SUMMARY OF THE INVENTION

We provide a method and display for selling window coverings in which we first establish a pricing table for each style of window covering. Style may be a type of window covering, such as a pleated shade, or may be a species of a type of product, such as a pleated shade with white on one side and a selected color on the other side. The prices are assigned according to the width and length of the window covering when the window covering is in a closed position. Then we provide a cabinet or other structure having two portions. The first portion displays at least one sample window covering that is representative of a style of window covering being offered for sale. Alternatively, that portion may contain color photographs of the products. This portion may be a window, a mock window or a wall. The second portion contains a plurality of swatch cards in a rack, drawers or other holder that is easily accessible to a customer. There is one swatch card corresponding to each color and style of windows coverings being offered for sale. Preferably, there are multiple copies of each swatch card.

Each swatch card contains a sample of window covering material and the pricing table for the style of window covering to which the sample of window covering material applies. The swatch card will also contain other information applicable to the product. That information could be product name, product identification number, vendor name, vendor address, vendor telephone number, manufacturer information, window covering material name, window covering material color, window covering material identification number, any available choices of manner in which the window covering material is opened and closed, location of tilt control, location of lift control, shipping options, available discounts, available options, and whether the shape of the window covering in the closed position is rectangular, arch, circular or angled. The information could be presented as text or illustrations or a combination of text and illustrations.

The window covering products being offered for sale can usually be divided into product families. Those product families could be pleated shades, cellular shades, single cell cellular shades, double cell cellular shades, roman shades, vertical blinds, vinyl vertical blinds, wood vertical blinds, composite vertical blinds, venetian blinds, vinyl venetian blinds, wood venetian blinds, composite venetian blinds, aluminum venetian blinds, 1" venetian blinds, 1½ venetian blinds, 2" venetian blinds, and roll-up shades. We prefer that each swatch card contain the name of the product family in which the product falls. We further prefer to color code the cards so that all cards for products in a single family are the same color. The color may cover the entire card or be a band or other shape on the upper front portion of the card.

When a customer sees the display he or she first looks at the sample blinds. Upon seeing a blind of interest the customer can look through the swatch cards for that type of window covering. From that group of swatch cards the customer can select the card or cards that have window covering materials in a color and texture that is appealing to him or her. At that point the customer can look at the pricing table to determine if the selected window covering is within his or her budget. If it is not, the customer can return the card to the display. The entire transaction does not require the assistance of a salesperson. If the selected product is priced at an amount that the customer is willing to pay, the customer can consult a sales person to place an order or can take the swatch card home with him or her and defer the purchase decision until after viewing the swatch of window covering material in the environment where the window covering will be installed. The retailer may make a modest charge for each card taken by the customer. This charge not only provides a reimbursement of the retailer's sample costs but also discourages the customer from taking swatch cards for products that he or she is not likely to buy.

Other objects and advantages of our method and display for selling window coverings will become apparent from a description of certain present preferred embodiments thereof which are shown in the drawings.

DETAILED DESCRIPTION OF THE PREFERRED EMBODIMENTS

Figure 1:
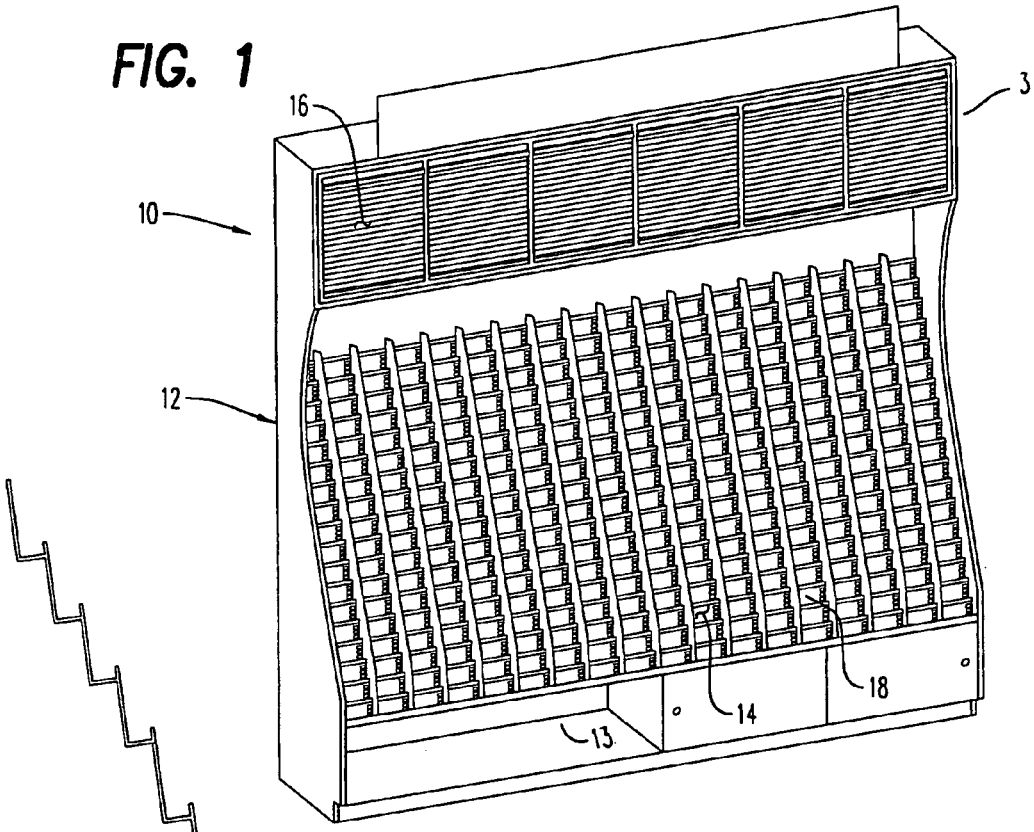
FIG. 1 is a perspective view of one present preferred embodiment of a display unit in accordance with the present invention.
Figure 2:
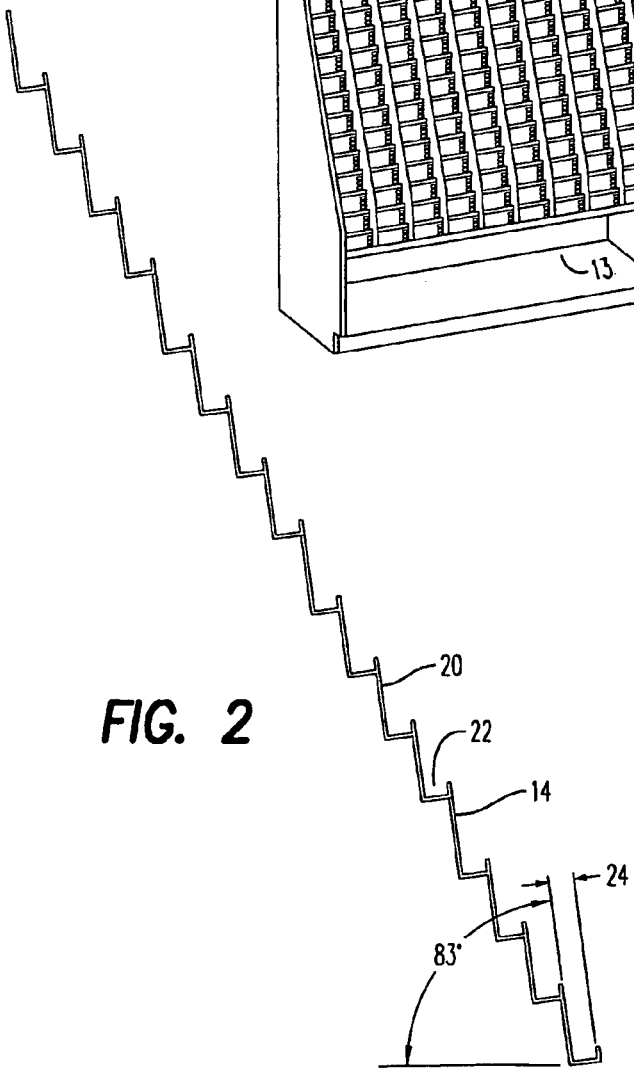
FIG. 2 is a side elevational view of one of the swatch card racks in the display unit shown in FIG. 1.

Referring now to the drawings, and particularly to FIGS. 1 and 2, a first preferred embodiment of our display for selling window coverings 10 includes a display unit or cabinet 12 having racks 14 containing a plurality of columns of pockets each holding a group of window covering product swatch cards 18 which will be described in more detail hereinbelow. The upper portion 3 of the display unit 12 has a plurality of actual operable sample blinds 16 mounted thereon. This portion may be a wall or preferably a storage bin which contains additional blind samples or swatch cards. Additional storage bins 13 are provided beneath the columns of pockets 14 as shown.

As seen in FIG. 2, each of the racks 14 of pockets 22 is formed of either metal or plastic thin wall material, preferably as a unit. The pockets 22 each have a generally upright back wall 20 which is inclined to horizontal preferably at an angle of about 83° or between an angle generally of 70° to 90° so as to maintain the swatch cards 18 contained in the pocket in a rearwardly leaning and stable orientation. The width 24 of each pocket 22 is sized to receive a preselected group or number of swatch cards 18. Each pocket may contain multiple copies of the same swatch card. The swatch cards should be organized or grouped so that swatch cards for each type of product are placed near one another. Typically, a single row or column of swatch cards will all relate to the same type of product.

Figure 4:
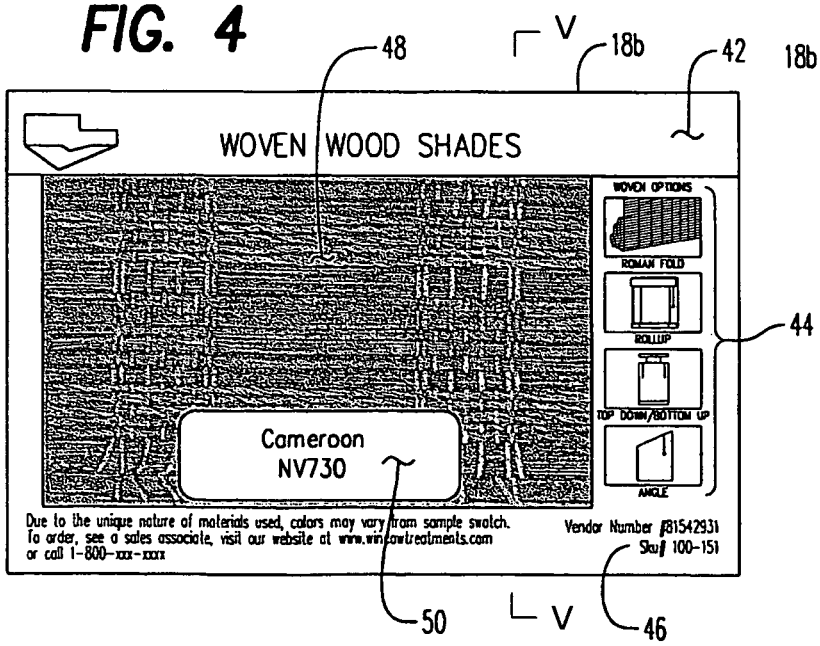
FIG. 4 is a front elevational view of a second preferred embodiment of our window swatch card.
Figure 5:
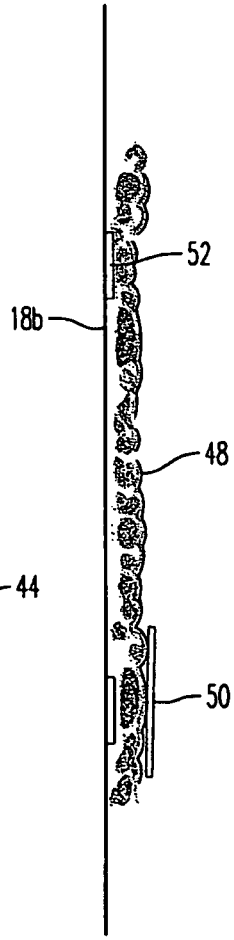
FIG. 5 is a sectional view taken along the line V—V of FIG. 4.
Figure 6:
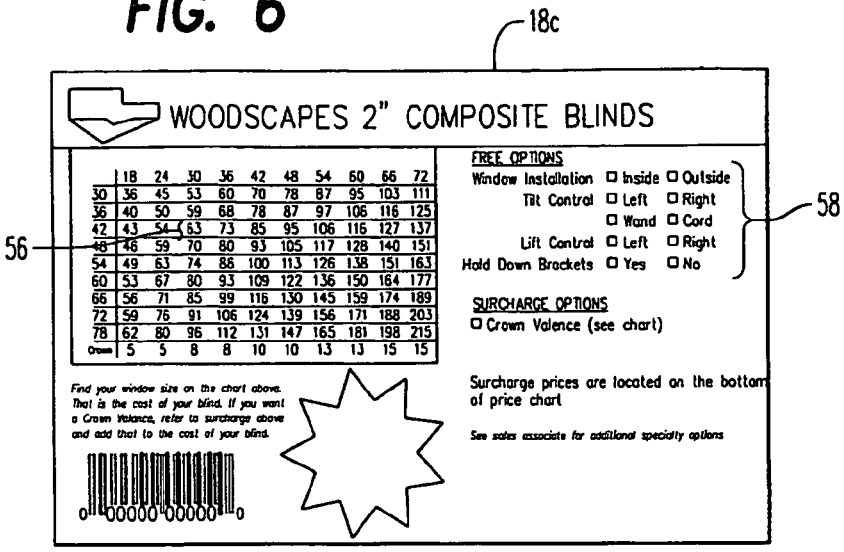
FIG. 6 is a rear elevational view of a third preferred embodiment of our swatch card.
Figure 7:
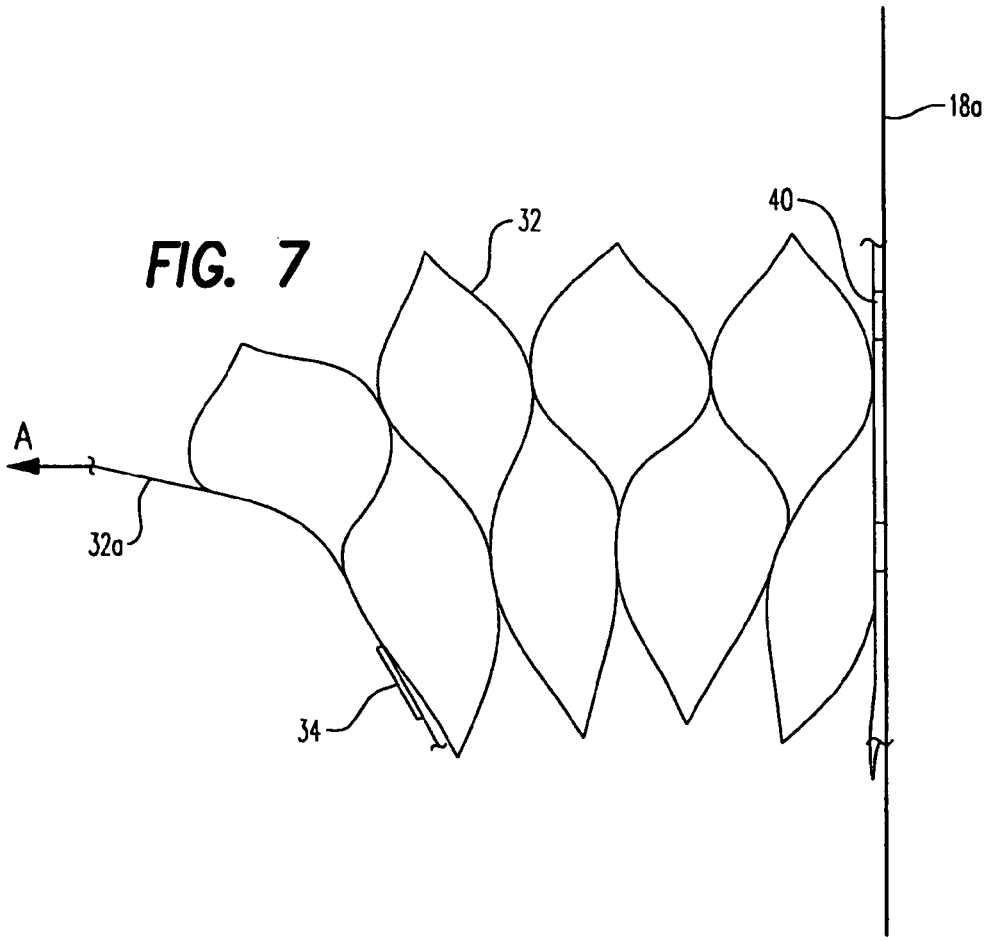
FIG. 7 is a side elevational view of the swatch card of FIG. 3 with the window covering material pulled outward from the card.
Figure 16:
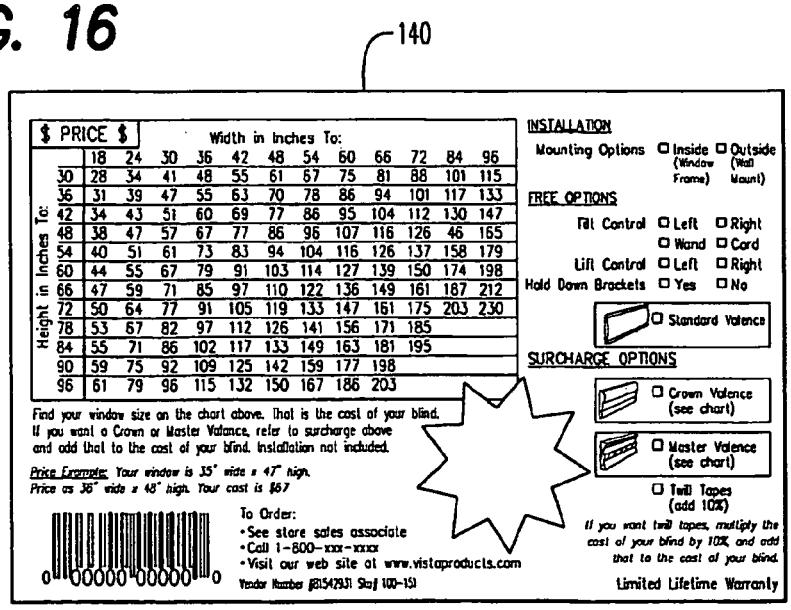
FIG. 16 is a rear elevational view of a fourth preferred embodiment of our swatch card.

Examples of swatch cards bearing various types of window treatment material are shown in FIGS. 3 to 9 and 16. Each swatch card contains a sample of window covering material on the front and a pricing table on the back. The swatch cards preferably are the size of standard index cards, namely 3 inches by 5 inches. The swatch of window covering material placed on each card may have a height of from 1¾ inches to 2 inches and a width of 3 inches. Consequently, the swatch does not cover the entire front surface of the card, leaving room for other information. The back of the swatch card contains a pricing table as shown in FIGS. 6 and 16. The size of the pricing table will depend upon the number of length and width combinations in which the window covering product is offered, as well as available options. The pricing table should not cover the entire back surface of the swatch card.

Figure 3:
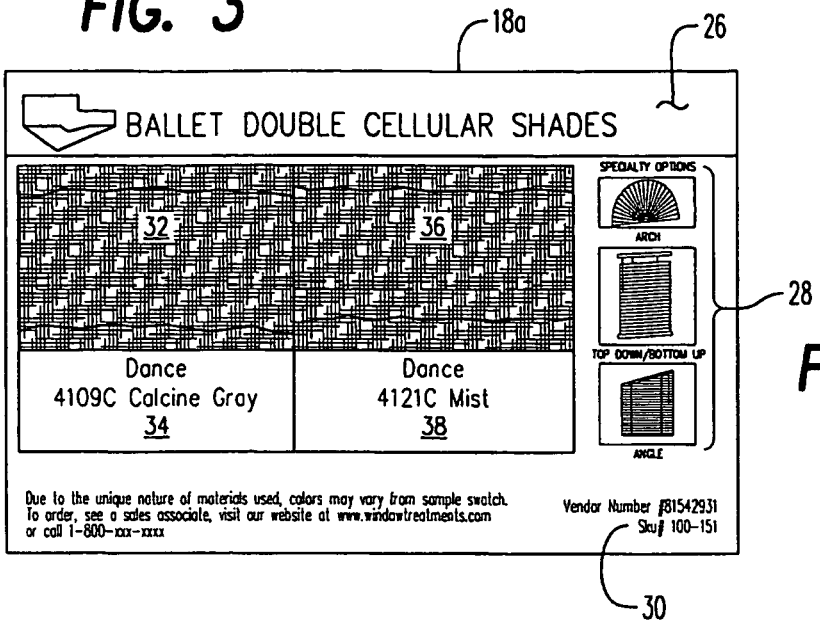
FIG. 3 is a front elevational view of a present preferred embodiment of our swatch card.

In FIG. 3 a swatch card 18*a* for a double cellular window shade is shown having two samples 32 and 36 of window covering material. Each of the window treatment material samples 32 and 36 bear a product identification label 34 and 38 bearing the material name, identification number and color. Specialty options 28, which here are installation options for the particular window treatment, are also provided on the front of the swatch card as illustrations. Vendor information 30 also appears on the front of the card 18*a*. In this swatch card embodiment 18*a*, the swatch of double cellular shade material 32 may be pulled away from the card in the direction of arrow A in FIG. 7 while holding the swatch card 18*a*. This allows the customer as to expand the sample 32 as shown. The swatches of window covering material 32, 36 are attached to swatch card 18*a* by an adhesive 40.

Referring now to FIGS. 4 and 5, front and side views of a second preferred embodiment of the swatch card 18*b* are shown. This embodiment 18*b* includes a window covering material 48 which is a woven wood formed of lengths of slender actual wood material. The product identification 42 is given on the upper portion of the card. This particular product is available as a roman shade, a roll-up shade, a top down, bottom up shade and an angle shade. These options are shown by labeled illustrations 44. The vendor identification number 46 appears at the bottom of the card. A specific product name and number is attached to the sample 48 by an adhesive label 50.

Referring to FIG. 6, the back of a swatch card 18*c* for yet another type of window covering is shown. A pricing table 56 with instructions for use of the table appears on the left side of the card. As is apparent from the table, prices are based upon the width and length of the shade in a closed position which correspond to the dimensions of the window to be covered. Consequently, one can consider window dimension, when used in the context of window coverings, to be a way of expressing the width and length of the window covering product which will cover that window. This is true even though the width and length of the window covering may be somewhat less than the width and length of the window. Those window dimensions are easily determined by the customer. A customer can find the height and width of his or her window in the table and locate the price for the window covering in the table. In this embodiment the product name appears on the back of the card 18*c* as well as the front of the card (not shown). As in the other swatch cards previously described the title block is color coded. This product is available with a tilt control and lift cords that can be on the left or right of the blind. Hold down brackets and a crown valance are also available. Text 58 on the card 18*c* tells the customer about these options. This swatch card 18*c* also contains a discount offer based upon a 45 day delivery and a bar code. The bar code may identify the swatch card or the window covering product corresponding to the swatch card.

The back of another present preferred swatch card 140 shown in FIG. 16 also contains a pricing table, with instructions, installation options, options, a bar code and available discount. The back of the card does not contain the product name or product family. That information appears on the front of the card (not shown). However, warranty information and order information including a toll free telephone number and website are provided. This card also contains an example price calculation.

Figure 8:
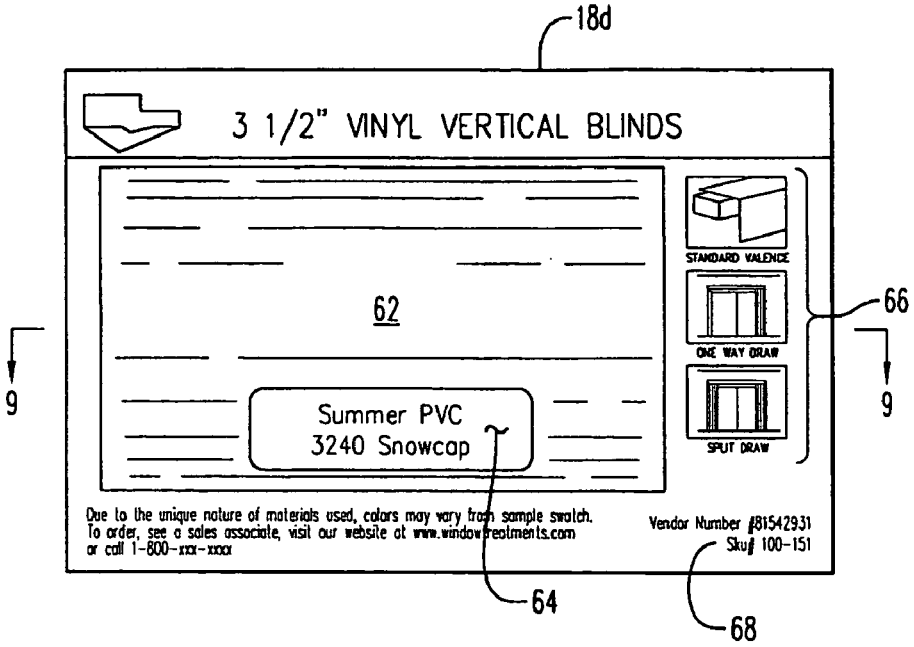
FIG. 8 is a front elevational view of a fourth preferred embodiment of our swatch card.
Figure 9:
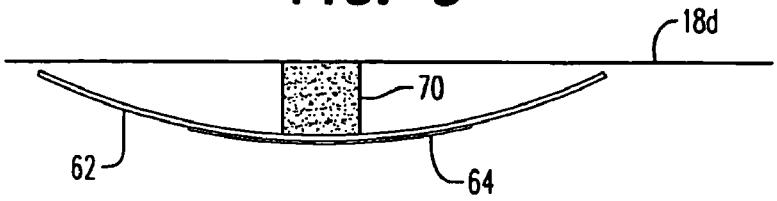
FIG. 9 is a sectional view taken along the line IX—IX in FIG. 8.

Referring now to FIGS. 8 and 9, a fourth embodiment of the swatch card 18*d* is used for vinyl vertical blinds. An actual segment of vertical blind slat 62 is attached to the front of the card. To attach this window treatment material 62, a thick compressible double-sided adhesive member 70 is attached as shown in FIG. 9 between the swatch card 18*d* and the back surface of the sample 62. A specific product identification label 64 is adhesively attached to the outer surface of the sample 62 while installation option 66 and vendor identification 68 are also provided on the swatch card 18*d*.

The present preferred swatch cards shown in the drawings have an actual piece of window covering material on the front of the card and the pricing table is printed on the back of the card. The invention is not limited to this particular configuration. The window covering material and pricing table may appear on the same side of the card. One could use a color photograph or color reproduction of the window covering material rather than an actual sample. However, if a photograph or reproduction is used the colors in the photograph or reproduction should be identical or nearly identical to the colors in the material that will be sold.

The present preferred swatch cards are fully assembled prior to being presented to the customer. However, one could provide a display in which the customer gathers the appropriate material needed for the product of interest from different locations in the display and the customer assembles them together. For example, a retailer may offer the same fabric in pleated, single cell and double cell forms on the same hardware system, but at different prices for pleated, single cell or double cell. A single swatch card may contain a flat piece of fabric with a letter P, S or D corresponding to pleated, single cell or double cell fabric. Another set of cards or a wall display may have a pricing table, similar to the table shown in FIG. 6 or 16, one table for pleated product, another table for single cell product, and a third table for double cell product. The consumer would then select the card having the appropriate pricing table and put that card together with the card bearing the piece of fabric. Alternatively, the consumer may consult the wall display, and copy the price, or place a sticker bearing the price or a series of prices, onto the card bearing the sample. In this instance the swatch card would have a reference to the applicable pricing table in the display. That reference may be the title of the pricing table or instructions to consult the display for price information. The term pricing table as used here is not limited to a matrix having several rows and columns such as is shown in FIGS. 6 and 16, but is any representation that conveys pricing information to the customer. Another option is to provide a pricing table which covers more than one product type. For example, one table may have prices for pleated, single cell and double cell products. The pricing table or reference could simply be identified by a letter or number rather than a product name. The pricing table applicable to a particular product would be listed on the swatch card by table name such as "Price Group A" or "Table I." The applicable pricing table could be selected based upon not only the type of window product offered, but also based upon delivery time, quantity purchased, promotional offers or other factors.

Figure 10:
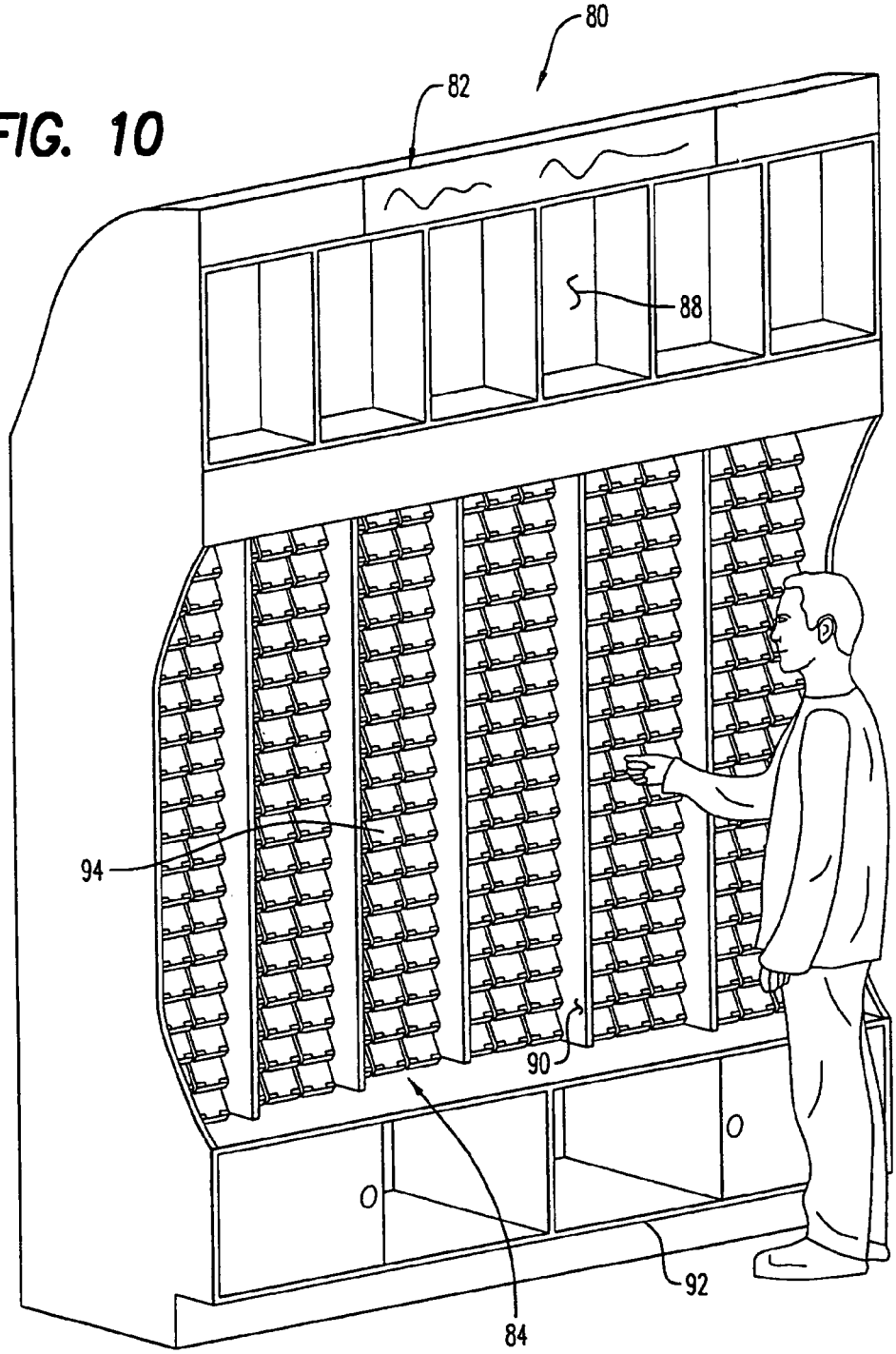
FIG. 10 is a perspective view of a second preferred embodiment of our display unit for selling window coverings.

A second present preferred display unit 80, shown in FIG. 10, has several racks 84 of swatch cards 94. The racks are shown in detail in FIGS. 11 and 12. The upper portion 82 of the display unit 80 has several storage bins 88. A sample of a window covering product is mounted in front of each storage bin. Thus, the upper portion 82 of this display unit 80 will be similar to the upper portion of the display unit 10 shown in FIG. 1. In the central portion each rack 84 of swatch cards is on a back panel. The back panel as well as the racks can be removable from the display unit 80. Upright panels 90 separate sets of racks 84.

Figure 11:
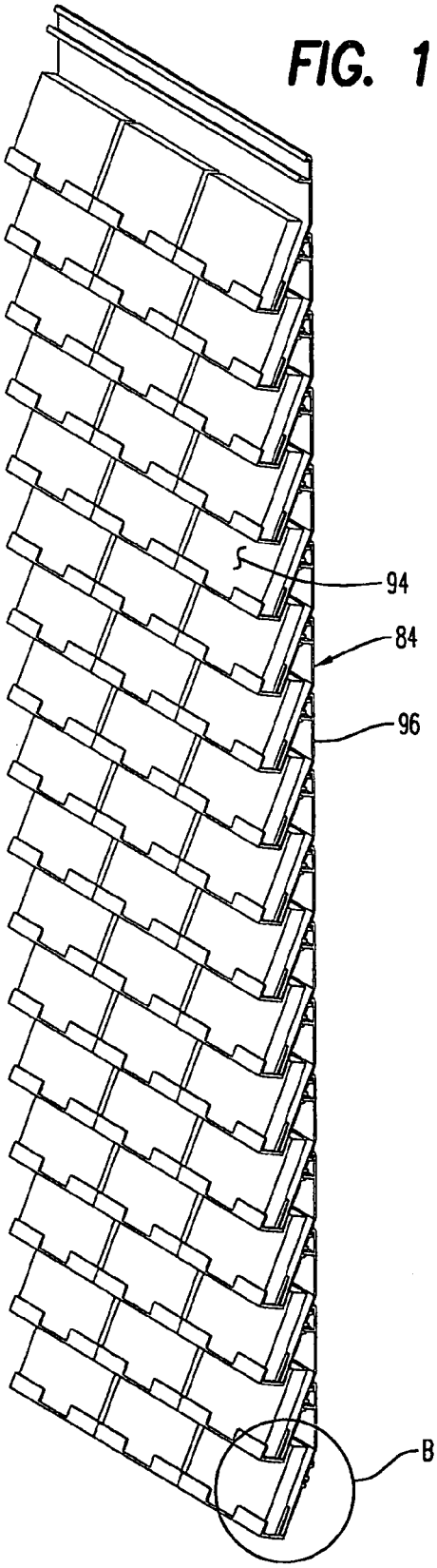
FIG. 11 is a perspective view of one of the modules which are insertable in side-by-side fashion into the display unit shown in FIG. 10.
Figure 12:
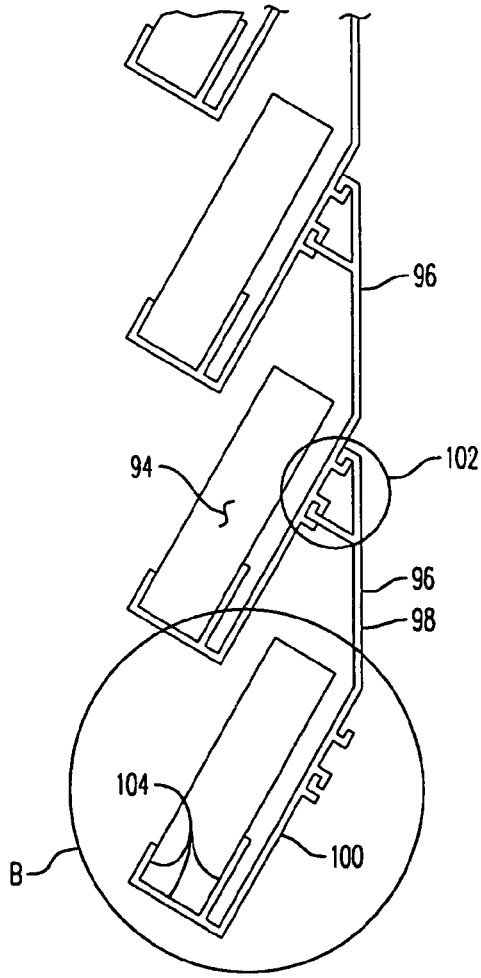
FIG. 12 is an enlarged side elevational view of the lower portion of the module shown in FIG. 11.

As shown in FIGS. 11 and 12, each rack is a set of interlocked pockets 96 having an upright back 98 and a diagonally downwardly extending support panel 100 which lock together as shown within circle 102. A group 94 of swatch card samples fits snugly into the cavity 104 so that the swatch cards lean rearwardly for both visual selection and stability. Lower storage bins 92 provide additional storage space for extra swatch cards and sample blinds.

Figure 13:
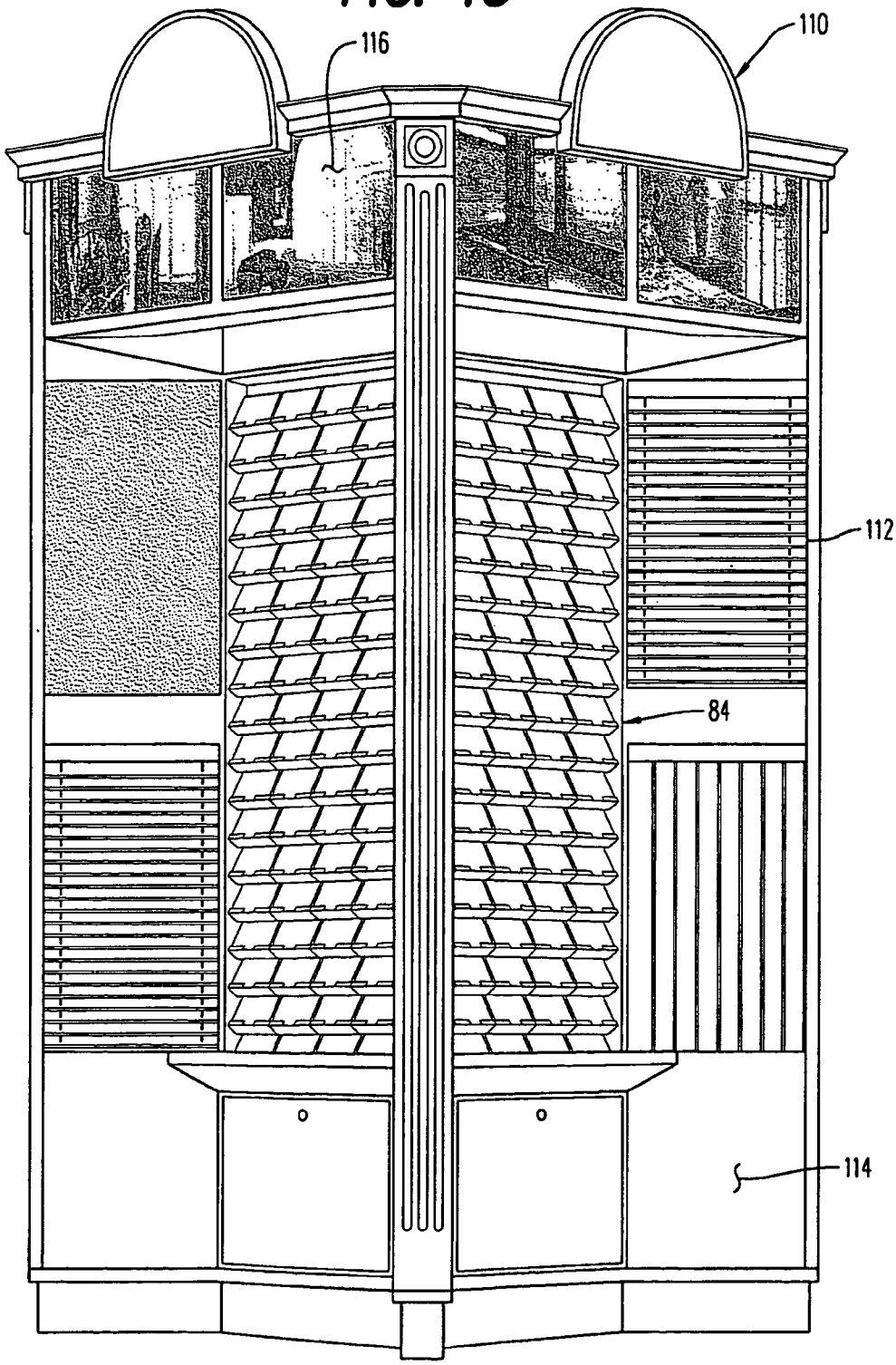
FIG. 13 is a perspective view of a third preferred embodiment of our display unit.

Another present preferred display unit 110, shown in FIG. 13, also contains the racks 84 shown in FIGS. 11 and 12 to hold swatch cards and storage bins 114. This embodiment displays sample window covering products 112 on walls beside the racks. Photographs 116 of rooms containing window covering products of the type being offered for sale are placed above the rack of swatch cards.

Figure 14:
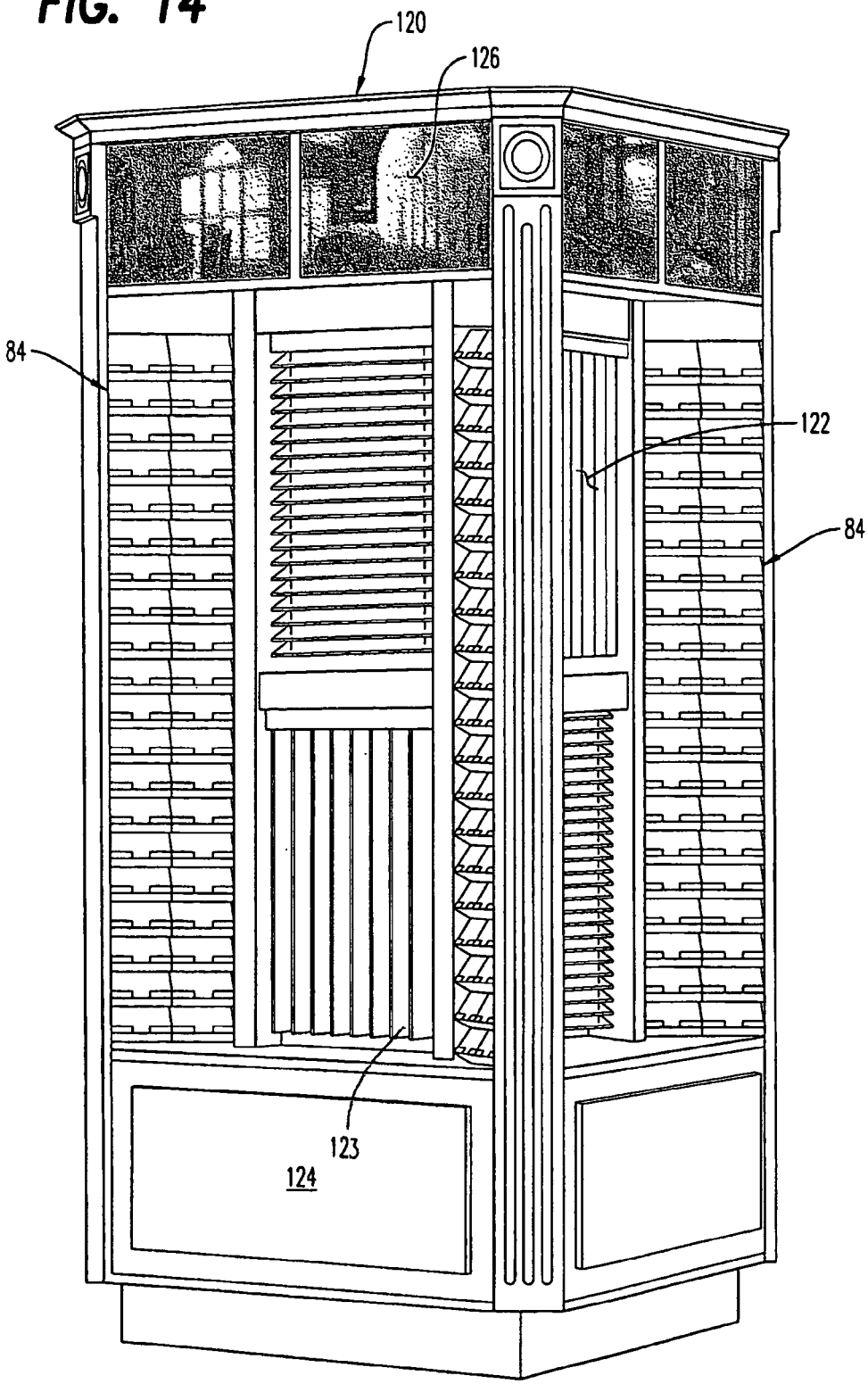
FIG. 14 is a perspective view of a fourth preferred embodiment of our display unit.

A fourth present preferred display unit 120, shown in FIG. 14, has several windows 123 and a different sample of window covering product 122 mounted on each window. Racks 84 of swatch cards are mounted on either side of the window. Photographs 126 of rooms containing window covering products of the type being offered for sale appear at the top of the cabinet. Storage bins 124 are provided in the bottom of the display unit.

Figure 15:
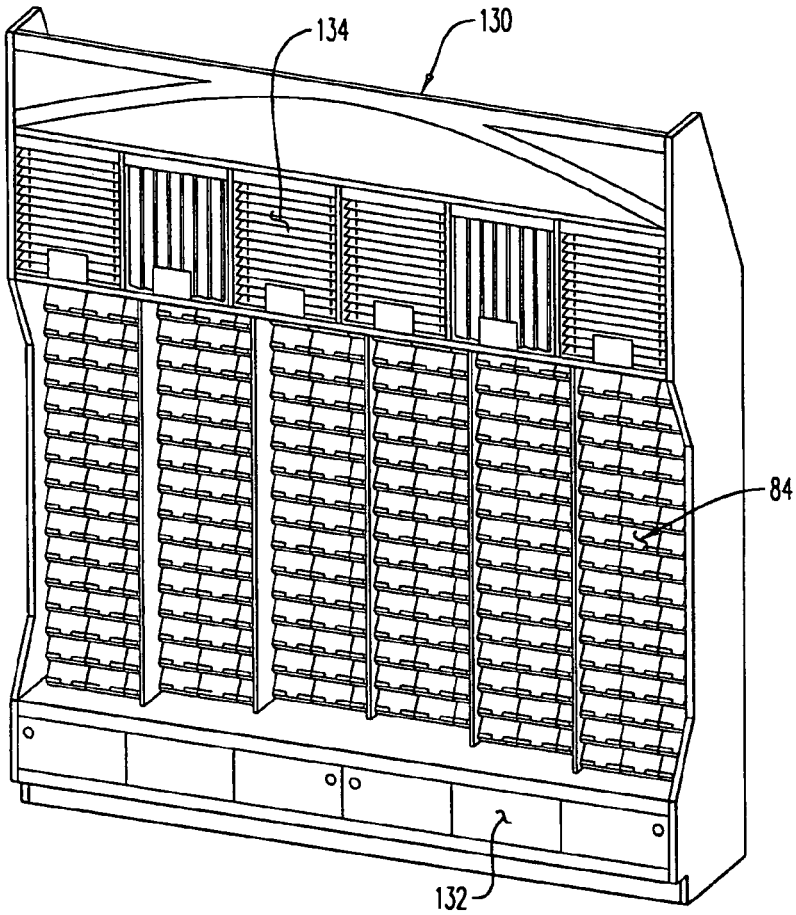
FIG. 15 is a perspective view of a fifth preferred embodiment of our display unit.

A fifth present preferred display unit 130, shown in FIG. 15, is similar to the embodiment of FIG. 1. Racks 84 of swatch cards are provided in the central portion of the display above storage compartments or drawers 132. Sample window covering products 134 are mounted on top of the display.

Although we prefer to provide actual product samples on the display which holds the swatch cards, one could substitute color photographs of the window covering product. Those photographs may show the product in a room as in photographs 116 and 126 in FIGS. 13 and 14. Or, the photographs may show only the window covering product. This type of display may be similar to any of the displays in FIGS. 1, 10, 13, 14 or 15 with photographs appearing in place of the product samples.

It should be apparent that the display unit could be configured in other ways such that the racks or other display of swatch cards and sample blinds or photographs are in different positions relative to one another. Moreover, the swatch card racks and sample blinds could be on different structures located in close proximity to one another but not attached together. Fewer or more blind segments and racks of swatch cards than contained in the preferred embodiments could be used.

One or more display units are placed in a retail store or showroom. A customer looking for a window covering product will go to the display and probably first look at the sample blinds. Each sample blind may be labeled by the product name or color which appears on the swatch cards associated with that product. Upon seeing a product of interest the customer should be able to readily find the related swatch cards in the display racks. The customer then looks through the group of cards for the product of interest and selects the card or cards having a swatch of window covering material which appeals to the customer. After removing the card from the rack, the customer can find the price for the product in the pricing table on the back of the card. The customer will also learn from the card which options are available. At that point the customer can decide if he or she can obtain the product and any desired options at an acceptable price. If so, the customer can find a sales person and place an order. If not, the customer can return the card to the rack without any involvement from a sales person.

Some customers may wish to take one or more swatch cards from the store to observe the window covering material in the environment where the window covering product will be installed. The swatch cards of the present invention can be easily carried by the customer. Moreover, each swatch card may contain sufficient information to enable the customer to place an order by telephone or over the Internet. The retailer may make a modest charge for each card taken by the customer. This charge not only provides a reimbursement of the retailer's sample costs, but also discourages the customer from taking swatch cards for products that he or she is not likely to buy. All or a portion of the charge can be refunded when the card is returned.

Although we have shown and described certain present preferred embodiments of our method and display for selling window coverings, it should be distinctly understood that our invention is not limited thereto, but may be variously embodied within the scope of the following claims.

We claim:

1. A method of selling window coverings of the type in which a window covering material is hung from a headrail and can be moved between an open position and a closed position, the window coverings each having a size determined by a length and a width of the window covering when in the closed position, the window coverings being available in a plurality of styles, each style based upon at least one of type and color of window covering material, manner in which the window covering material is opened and closed, location of any tilt control, location of any lift control, available options, and whether the shape of the window covering in the closed position is rectangular, arch, circular or angled, wherein the method comprises:

establishing for each style of window covering a pricing table in which prices are assigned according to the length and width of the window covering when in the closed position;

providing a display having a first portion and a second portion in which the first portion contains at least one sample window covering representative of a style of window covering being offered for sale, and a second portion containing a plurality of swatch cards, each swatch card corresponding to one of the styles of windows coverings being offered for sale; and providing on each swatch card, a sample of window covering material, the pricing table for the style of window covering to which the sample of window covering material applies and further applicable information selected from the group consisting of product name, product identification number, vendor name, vendor address, vendor telephone number, manufacturer information, window covering material name, window covering material color, window covering material identification number, text indicating any available choices of manner in which the window covering material is opened and closed, location of tilt control, location of lift control, shipping options, available discounts, available options, and whether the shape of the window covering in the closed position is rectangular, arch, circular or angled, and illustrations indicating any available choices of manner in which the window covering material is opened and closed, location of any tilt control, location of any lift control, shipping options, available discounts, available options, and whether the shape of the window covering in the closed position is rectangular, arch, circular or angled.

2. The method of claim wherein multiple copies of swatch cards are provided for at least one of the styles of window coverings.

3. The method of claim 1 also comprising permitting customers to select and remove from the display at least one swatch card.

4. The method of claim 3 also comprising charging the customer for the at least one swatch card removed from the display by the customer.

5. The method of claim 4 also comprising refunding at least a portion of an amount charged the customer for removing the at least one swatch card removed from the display by the customer.

6. The method of claim 1 also comprising grouping the window coverings being offered for sale into product families and placing on each swatch card at least one of a text and a color corresponding to the product families in which the window covering product corresponding to the swatch card has been grouped.

7. The method of claim 6 wherein the product families are selected from the group consisting of pleated shades, cellular shades, single cell cellular shades, double cell cellular shades, roman shades, vertical blinds, vinyl vertical blinds, wood vertical blinds, composite vertical blinds, venetian blinds, vinyl venetian blinds, wood venetian blinds, composite venetian blinds, aluminum venetian blinds, 1" venetian blinds, 1½ venetian blinds, 2" venetian blinds, and roll-up shades.

8. The method of claim 6 wherein the swatch cards are presented in the display in groups, each group consisting of those swatch cards that correspond to a single product family.

9. The method of claim 1 wherein the first portion and the second portion of the display are in a single cabinet.

10. The method of claim 1 wherein the window covering material is attached to the swatch card so that the at least a portion of the window covering material is removable from the swatch card.

11. The method of claim 1 wherein the pricing table is provided on the swatch card by a customer who selects a swatch card having a sample of window covering material from one location and selects a pricing table from a different location and combines the pricing table with the swatch card.

12. The method of claim 1 wherein the pricing table is in matrix form having a plurality of rows and columns.

13. A method of selling window coverings of the type in which a window covering material is hung from a headrail and can be moved between an open position and a closed position, the window coverings each having a size determined by a length and a width of the window covering when in the closed position, the window coverings being available in a plurality of styles, each style based upon at least one of type and color of window covering material, manner in which the window covering material is opened and closed, location of any tilt control, location of any lift control, available options, and whether the shape of the window covering in the closed position is rectangular, arch, circular or angled, wherein the method comprises:

establishing for each style of window covering a pricing table in which prices are assigned according to the length and width of the window covering when in the closed position;

providing a display having a first portion and a second portion in which the first portion contains at least one photograph of a style of window covering being offered for sale, and a second portion containing a plurality of swatch cards, each swatch card corresponding to one of the styles of windows coverings being offered for sale; and providing on each swatch card, a sample, photograph or reproduction of window covering material, the pricing table for the style of window covering to which the sample of window covering material applies and further applicable information selected from the group consisting of product name, product identification number, vendor name, vendor address, vendor telephone number, manufacturer information, window covering material name, window covering material color, window covering material identification number, text indicating any available choices of manner in which the window covering material is opened and closed, location of tilt control, location of lift control, shipping options, available discounts, available options, and whether the shape of the window covering in the closed position is rectangular, arch, circular or angled, and illustrations indicating any available choices of manner in which the window covering material is opened and closed, location of any tilt control, location of any lift control, shipping options, available discounts, available options, and whether the shape of the window covering in the closed position is rectangular, arch, circular or angled.

14. The method of claim 13 wherein multiple copies of swatch cards are provided for at least one of the styles of window coverings.

15. The method of claim 13 also comprising permitting customers to select and remove from the display at least one swatch card.

16. The method of claim 15 also comprising charging the customer for the at least one swatch card removed from the display by the customer.

17. The method of claim 16 also comprising refunding at least a portion of an amount charged the customer for removing the at least one swatch card removed from the display by the customer.

18. The method of claim 13 also comprising grouping the window coverings being offered for sale into product families and placing on each swatch card at least one of a text and a color corresponding to the product families in which the window covering product corresponding to the swatch card has been grouped.

19. The method of claim 18 wherein the product families are selected from the group consisting of pleated shades, cellular shades, single cell cellular shades, double cell cellular shades, roman shades, vertical blinds, vinyl vertical blinds, wood vertical blinds, composite vertical blinds, venetian blinds, vinyl venetian blinds, wood venetian blinds, composite venetian blinds, aluminum venetian blinds, 1" venetian blinds, 1½ venetian blinds, 2" venetian blinds, and roll-up shades.

20. The method of claim 18 wherein the swatch cards are presented in the display in groups, each group consisting of those swatch cards that correspond to a single product family.

21. The method of claim 13 wherein the first portion and the second portion of the display are in a single cabinet.

22. The method of claim 13 wherein the window covering material is attached to the swatch card so that the at least a portion of the window covering material is removable from the swatch card.

23. The method of claim 13 wherein the pricing table is provided on the swatch card by a customer who selects a swatch card having a sample of window covering material from one location and selects a pricing table from a different location and combines the pricing table with the swatch card.

24. The method of claim 13 wherein the pricing table is in matrix form having a plurality of rows and columns.

* * * * *